US006056119A

United States Patent [19]

Risgalla et al.

[11] Patent Number: 6,056,119

[45] Date of Patent: May 2, 2000

[54] INFLATABLE PACKAGING

[75] Inventors: Eric Risgalla, Prevessin-Moens; Xavier De Saint-Sauveur, Ferney-Voltaire, both of France

[73] Assignee: Walk Pak Holding NV, Curacao, Netherlands Antilles

[21] Appl. No.: 09/165,641

[22] Filed: Oct. 2, 1998

Related U.S. Application Data

[63] Continuation of application No. PCT/IB97/00332, Apr. 2, 1997.

[51] Int. Cl.[7] ..... B65D 81/02

[52] U.S. Cl. ..... 206/522

[58] Field of Search ..... 383/3, 205, 207, 383/208, 209; 206/522, 524.8

[56] References Cited

U.S. PATENT DOCUMENTS 5,447,235 9/1995 Pharo .
5,469,966 11/1995 Boyer ..... 206/522
5,476,175 12/1995 Jaszai ..... 206/522

*Primary Examiner*—Jacob K. Ackun
*Attorney, Agent, or Firm*—Henderson & Sturm

[57] ABSTRACT

Inflatable packaging including a valve formed by a channel made between two flexible sheets extending at least partly inside the inflatable packaging and having a first opening communicating to outside of the packaging and a second opening communicating to inside of the packaging, the two flexible sheets being designed to be pressed against each other as soon as a force keeping the flexible sheets apart is removed, thus preventing an inflating gas from escaping from the packaging, wherein the two flexible sheets extend between two edges of the packaging and the first opening coincides with a second opening passing through one wall of the packaging, the edges of the first opening and the second opening being welded to each other and, upstream of the first opening, the two flexible sheets are welded to a body of a tab cut into the one wall of the packaging, wherein the tab includes one tab end by which the tab may be grasped which is free with respect to the two flexible sheets, and the tab is isolated from an internal volume of the packaging by a peripheral weld.

2 Claims, 2 Drawing Sheets

1
2
3
4
5
6
7
8
a
b
c
d
e
f
II
III
IV
V
VI
VII 1
2
3
6

INFLATABLE PACKAGING

CROSS-REFERENCE TO RELATED APPLICATIONS

This application is a continuation of PCT/IB97/00332 filed Apr. 2, 1997.

STATEMENT REGARDING FEDERALLY SPONSORED RESEARCH OR DEVELOPMENT

Not Applicable.

BACKGROUND OF THE INVENTION

1. Field of the Invention

The present invention relates to an inflatable packaging comprising a valve formed by a channel made between two flexible sheets extending at least partly inside said walls and having a first opening communicating with the exterior of the packaging and a second opening communicating with the interior of the packaging, these flexible sheets being designed to be pressed against each other as soon as a force keeping them apart is removed, thus preventing the inflating gas from escaping from the packaging.

2. Description of the Prior Art

The present invention also relates to an inflatable packaging comprising four superimposed flexible walls joined around part of their perimeter, then joined in pairs around the rest of the perimeters, in order to form a pocket between the two intermediate walls, a communication being formed through said intermediate walls, outside the pocket, in order to form an inflatable space on either side of this pocket, a valve formed by a channel made between two flexible sheets extending inside the walls of said inflatable space and having a first opening communicating with the exterior and a second opening communicating with the interior of said inflatable space, these flexible sheets being designed to be pressed against each other as soon as a force keeping them apart is removed, thus preventing the inflating gas from escaping from said inflatable space.

Such a packaging is known from its description in WO 95/23742 and one particular system for enabling the packaging to be deflated easily has been proposed in which a tab attached to an opening formed through one of the walls of this packaging is torn away. For this purpose the attached tab is welded around the opening passing through the wall, so that when this tab is pulled the wall is torn and the packaging deflates.

From the point of view of manufacture, the addition of the tab means introducing an extra component. The main disadvantage, however, has to do with the opening of the packaging: since the tab is welded to the wall of the packaging, pulling the tab away must tear this wall, but the wall must be as strong as possible to avoid being damaged during handling and transport. The whole purpose of such a packaging is of course to protect fragile merchandise during its transport, which means that to tear the wall by means of a tab may require too great an effort for this to be done by hand. It is also possible that it would be the tab that would tear around the weld, instead of the wall of the bag, necessitating the eventual use of a cutting or perforating tool to deflate the packaging and remove the merchandise from the pocket—which is precisely what it is wished to avoid.

BRIEF SUMMARY OF THE INVENTION

The object of the present invention is to at least partly solve the abovementioned problems.

To this end the subject of the invention is an inflatable packaging of the type described above, as defined by claim 1. The present invention may also be characterized in that said two flexible sheets pass through a part of the packaging and in that said first opening coincides with an opening passing through one wall of the packaging, the edges of these two openings being welded to each other and in that, upstream of this first opening, said two flexible sheets are welded to the body of a tab cut into one of the walls of the packaging, of which one end by which this tab may be grasped is free with respect to said flexible sheets, this tab being isolated from the internal volume of the packaging by a peripheral weld.

The principle advantage of this invention lies in the fact that in order to open the inflatable portion of the packaging the user does not tear the wall of the packaging but destroys the valve. The reason for this is that whereas the wall of the packaging must of course be strong enough not to be damaged during transport, the wall of the valve is as flexible as possible, and therefore thin, to enable the channel to be closed satisfactorily by the pressure in the inflatable portion. As a result it is much easier to tear the wall of the valve than that of the inflatable bag. What is more, cutting the pull tab in the wall of the packaging bag itself saves having to add an extra component. It may also be mentioned that by creating the valve entrance by an opening formed through the wall of the bag, the channel can be arranged parallel to one edge of the bag, consequently limiting the width of the sheets in which the valve channel is formed, without reducing the length of the channel, which must be sufficient to guarantee the leaktightness of the inflatable part of the packaging.

BRIEF DESCRIPTION OF THE SEVERAL VIEWS OF THE DRAWINGS

The attached drawing illustrates, schematically and by way of example, an embodiment and a variant of the inflatable packaging forming the subject matter of the invention.

DETAILED DESCRIPTION OF THE INVENTION

Figure 1:
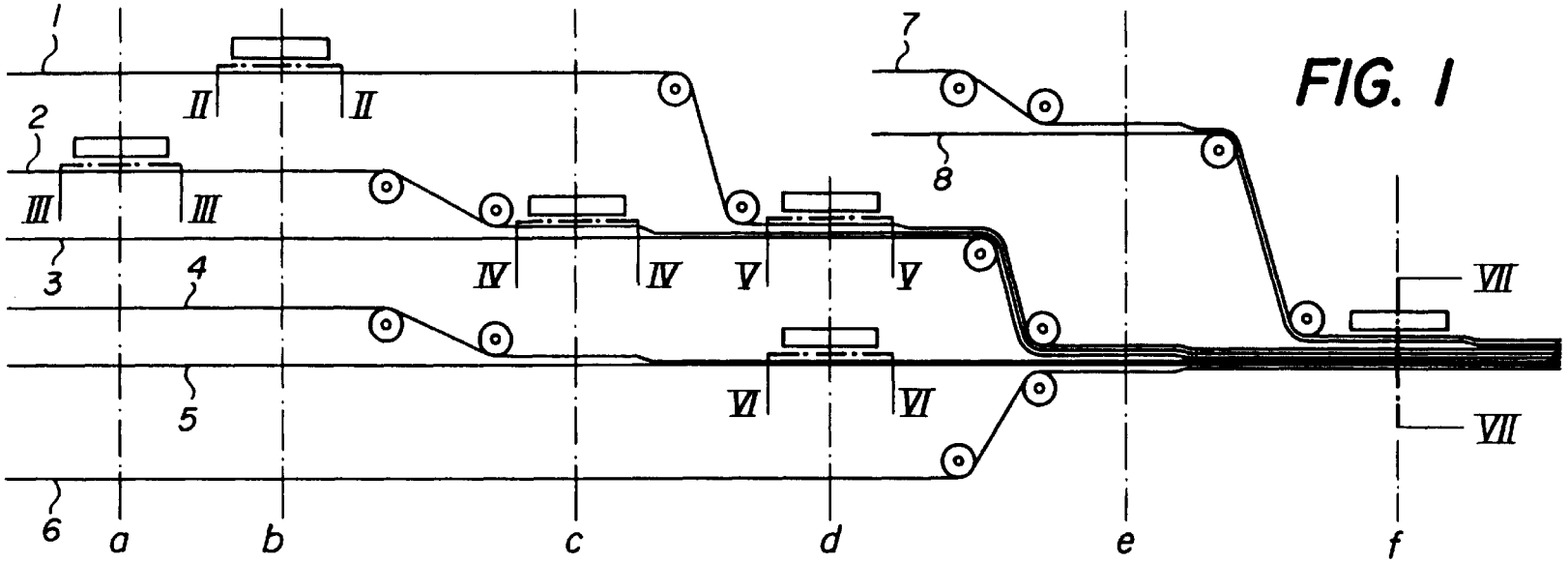
FIG. 1 is a side view illustrating the different steps of the process of manufacturing this embodiment.
Figure 8:
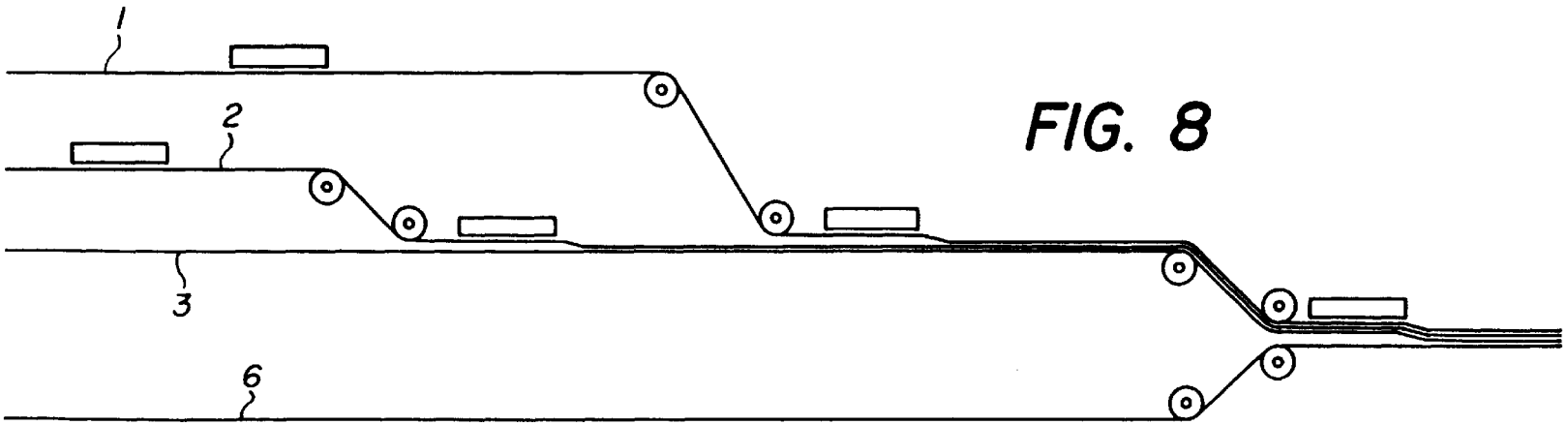
FIG. 8 is a side view of a variant of FIG. 1.

FIG. 1 shows eight bands 1 to 8 of endless single-layer or multilayer thermoplastic film such as polystyrene, polypropylene, polyethylene or polyamide which are used to produce the inflatable packaging that forms the subject matter of the present invention. The wider bands 1, 4, 5 and 6 will form the walls of the packaging bag, the narrower bands 2, 3 will form the valve, and bands 7 and 8 will form a flap with a pocket to hold information about the shipment.

The thickness of the film of bands 1, 4, 5, 6, 7 and 8 is preferably of the order of 100 $\mu$m, if not more, depending on the strength required, whereas the thickness of bands 2 and 3 that are to form the valve is approximately 40 $\mu$m so as to make them more flexible and thus facilitate the closing of the valve.

The different operations of manufacturing this packaging take place in line and are illustrated in FIGS. 2 to 6, in which the transverse limits of the bags are drawn in chain lines.

Figure 2:
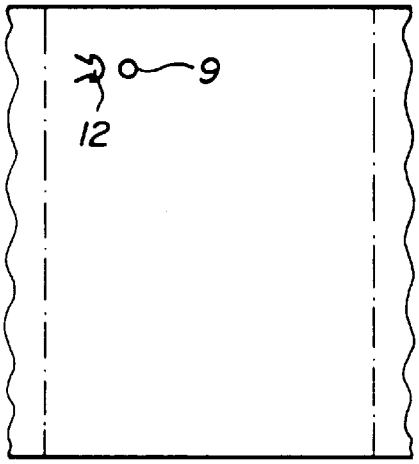
FIG. 2 is a plan view on the plane marked II—II in FIG. 1.
Figure 3:
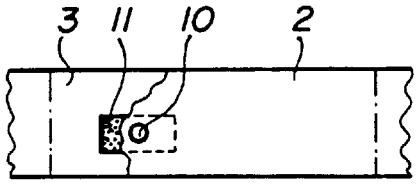
FIG. 3 is a plan view on the plane marked III—III in FIG. 1.
Figure 4:
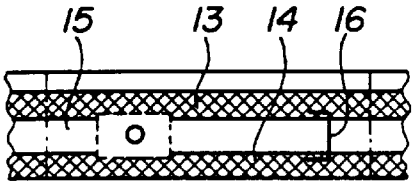
FIG. 4 is a plan view on the plane marked IV—IV in FIG. 1.

In stage a (FIG. 1) first of all, a hole 9 giving access to the valve is formed in band 1 which will form the front face of the packaging (FIG. 2). Parallel to this and in a position intended to coincide with the access hole 9, a hole 10 giving access to the channel of the valve, which will be described later, is formed in band 2. Opposite this hole 10 and on that face of band 3 which is nearest band 2, a layer of long-oil varnish 11 is deposited (FIG. 3).

Also in stage b (FIG. 1), a tab 12 is precut to the left of the access hole 9 in the front face, represented by sheet 1 (FIG. 2).

In stage c of the process the two bands 2 and 3 are welded along two parallel lines 13, 14 so that a channel 15 is formed between them from one edge of the packaging to the other, the positions of the not-yet-formed transverse edges being shown by the transverse chain lines. A cut 16 is also made to allow this channel 15 to communicate with the exterior, thereby completing the formation of the valve.

Parallel to this same stage c, a weld 17 (FIG. 6) is formed to assemble bands 4 and 5 that are to become the internal walls of the inflatable packaging. This weld 17 is U-shaped, its opening coinciding with one of the longitudinal edges of bands 4 and 5, and serves as a pocket 19 for holding the article to be packaged, which is introduced through the opening of the pocket 19. Between the ends of the arms of the U and on one of the adjacent faces of bands 4 and 5 a layer of long-oil varnish 18 is deposited to prevent the further welding of the opening of the pocket 19.

Between the closed end of the pocket 19 and the adjacent longitudinal edges of bands 4 and 5 an opening 20 is pierced through these bands and surrounded with a weld 21. This opening is to allow communication between the two inflatable parts of the packaging, as will be seen later.

Figure 5:
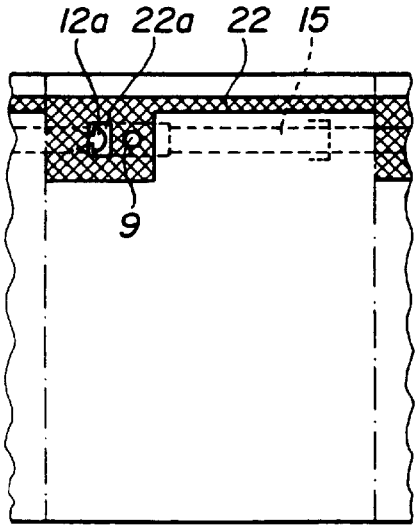
FIG. 5 is a plan view on the plane marked V—V in FIG. 1.
Figure 6:
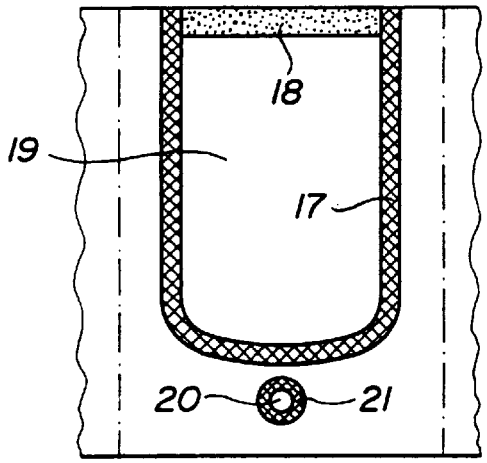
FIG. 6 is a plan view on the plane marked VI—VI in FIG. 1.

In the next stage d (FIG. 1), bands 2 and 3 are welded to the verso of band 1 along weld 22. This weld 22 welds together bands 2 and 3 to the verso of band 1 as shown in FIG. 5, welding the edges of the holes 9 and 10 together, while the long-oil varnish 11 prevents welding of sheets 2 and 3. An unwelded space 22*a* is reserved over the head 12*a* of the tab 12, so as to leave this head 12*a* free in order that it can be gripped when the packaging is to be opened, as will be explained below. The rest of the tab 12 is welded to band 2, which is itself welded to band 3, so as to allow the packaging to be opened.

In stage e of the process (FIG. 1), the superimposed bands 1, 2, 3, 4, 5 and 6 are all welded. Bands 2 and 3 are welded between bands 1 and 4. The presence of the long-oil varnish 18 between the ends of the arms of the U-shaped weld 19 [sic] prevents the edges of bands 4 and 5 from being welded at this point, so that it is possible to gain access to the interior of the pocket 19.

Figure 7:
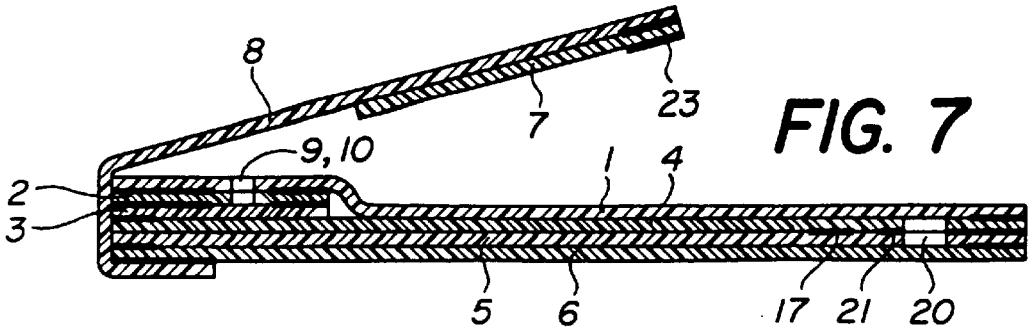
FIG. 7 is a sectional view on the plane marked VII—VII in FIG. 1.

Parallel to this operation, bands 7 and 8 are welded, sheet 8 being wider than sheet 7, along their adjacent longitudinal edges and transversely, the distance between two transverse welds corresponding to the width of the packaging, so that a pocket is formed between these two bands 7 and 8. Finally, in stage f, the free longitudinal edge of band 8 is welded to the back of the packaging bag obtained in stage e, as illustrated by the section shown in FIG. 7. The flap with pocket formed by bands 7 and 8 serves to hold information about the shipment. The flap is then folded in front of face 1 of the bag, against which it can then be bonded with a selfadhesive tape 23 laid along the outer edge of band 7.

To inflate the packaging a tube such as a straw is inserted through the superimposed openings 9, 10 of bands 1 and 2 and into the channel 15 forming the valve. Air is then introduced at pressure through this tube. This air inflates the space formed between sheets 1 and 4, and enters the space formed between sheets 5 and 6 via the opening 20. If an object has previously been placed in the pocket 19, the object will be completely surrounded by a protective cushion of air and is at the same time trapped inside the pocket whose flexible walls will mould themselves closely to the contours of the object. The tube is then withdrawn from the channel 15 so that its walls, formed by bands 2 and 3, are pressed together by the pressure difference between the interior and exterior of the packaging, sealing it in the process.

When the object is to be withdrawn from the pocket 19, the protective packaging must be deflated. To achieve this, the end 12*a* of the tab 12 is grasped and pulled so that that part of this tab 12 which is welded to the two walls 2, 3 of the valve, as explained with reference to FIG. 5, tears the valve so that the inflatable part of the packaging is in communication with the exterior.

The packaging described above has the function of protecting the object or objects placed in the pocket 19 during transport as it enables the contents of this pocket to be isolated from any direct contact with the exterior.

It is also possible to envisages [sic] a simpler variant designed purely to provide a packaging of unusual appearance without having any particular protective function.

For this purpose a single-walled packaging 1 and 6 is made with two narrower bands 2 and 3 to form the valve exactly as described and illustrated in FIGS. 2 to 5. Bands 4 and 5 are omitted, along with the flap 7, 8, so that all that is left is the external walls 1 and 6 welded together, except along one of their four sides so as to leave an opening through which the object to be packaged can be introduced and the valve formed between bands 2 and 3.

The rest of the packaging is the same as described previously. The only difference is that the inflatable part and the container pocket of the packaging are one and the same item. Consequently, as stated above, one side of the packaging is left open so that the user can insert the object to be packaged into the inflatable part, after which he will seal the last side of the packaging hermetically by welding it, and will inflate it in the same way as before. The packaging is also opened as described with reference to the previous embodiment.

What is claimed is:

1. Inflatable packaging comprising a valve formed by a channel made between two flexible sheets extending at least partly inside said inflatable packaging and having a first opening communicating to outside of the packaging and a second opening communicating to inside of the packaging, said two flexible sheets being designed to be pressed against each other as soon as a force keeping said flexible sheets apart is removed, thus preventing an inflating gas from escaping from the packaging, wherein said two flexible sheets extend between two edges of the packaging and said first opening coincides with a second opening passing through one wall of the packaging, the edges of said first opening and said second opening being welded to each other and, upstream of said first opening, said two flexible sheets are welded to a body of a tab cut into said one wall of the packaging, said tab comprising one tab end by which said tab may be grasped said one tab end being free with respect to said two flexible sheets, and said tab being isolated from an internal volume of the packaging by a peripheral weld.

2. Inflatable packaging according to claim 1, comprising four superimposed flexible walls joined around part of a perimeter, then joined in pairs around a remainder of the perimeter, in order to form a pocket between two intermediate walls also joined to each other to form at least part of the perimeter of the pocket; a communication formed between a closed end of the pocket and an end of the packaging through said intermediate walls.

* * * * *